United States Patent [19]

Gattrugeri

[11] Patent Number: 4,771,963

[45] **Date of Patent: * Sep. 20, 1988**

[54] EXPANSIBLE MANDREL WITH A PLURALITY OF EXPANSION DEVICES

[76] Inventor: Giovanni Gattrugeri, Viale Col di Lana, 2-Milano, Italy

[ * ] Notice: The portion of the term of this patent subsequent to Nov. 20, 2004 has been disclaimed.

[21] Appl. No.: 84,050

[22] Filed: Oct. 12, 1979

[30] Foreign Application Priority Data

Oct. 23, 1978 [IT] Italy ..... 28996 A/78

[51] Int. Cl.[4] ..... B65H 75/24

[52] U.S. Cl. ..... 242/72 B; 92/48; 92/92; 279/2 A

[58] Field of Search ..... 242/72 R, 72 B; 279/2 A; 92/48, 91, 92, 128

[56] References Cited

U.S. PATENT DOCUMENTS

| | | | |
|---|---|---|---|
| 3,214,109 | 10/1965 | Gadde | 242/72 |
| 3,233,341 | 12/1965 | Gadde | 242/72 B |
| 3,286,987 | 11/1966 | Bridges | 242/72 |
| 3,493,189 | 2/1970 | Seay | 242/72 |
| 3,552,672 | 1/1971 | Grettve | 242/72 B |
| 3,592,405 | 7/1971 | Young | 242/72 |
| 3,904,144 | 9/1975 | Gattrugeri | 279/2 A |
| 4,147,312 | 4/1979 | Secor | 242/72 R |

FOREIGN PATENT DOCUMENTS

| | | | |
|---|---|---|---|
| 1047002 | 12/1958 | Fed. Rep. of Germany . | |
| 2132823 | 1/1972 | Fed. Rep. of Germany | 242/72 B |
| 2324196 | 11/1973 | Fed. Rep. of Germany | 242/72 B |
| 2655935 | 6/1978 | Fed. Rep. of Germany | 242/72 B |
| 2348142 | 11/1977 | France . | |

*Primary Examiner*—Abraham Hershkovitz

*Attorney, Agent, or Firm*—Guido Modiano; Albert Josif

[57] ABSTRACT

An expansible mandrel with a plurality of fluid pressure actuated expansion devices, the devices including an expandable pressing shoe member, an inflatable tubular bladder member cooperating with said shoe member for actuating the expansion movement thereof and duct and valve means connectable with pressure fluid ducts for conducting and controlling the pressure fluid flow in and out of said bladder member. A channel section shaped housing member contains therein the shoe member and the bladder member and a connector member. The housing with therein the bladder member and the shoe member and the connector member constitutes a self-contained replaceable expansion device unit.

2 Claims, 2 Drawing Sheets

EXPANSIBLE MANDREL WITH A PLURALITY OF EXPANSION DEVICES

BACKGROUND OF THE INVENTION

The present invention concerns a fluid pressure actuated expansion device for a mandrel equipped with such expansion devices designed for holding in place spools or reels of material in the form of sheets or the like, such spools being made with cores of cardboard, steel aluminum or any other material, or simply consisting of material wound around itself and an expansion shaft with such devices.

Currently, there are commercially available several known types of pressure fluid actuated expansible mandrels securing spools of cardboard, plastic material, fabric or the like, all of which are essentially based on the principle of obtaining the expansion of longitudinal elements or pins so as to protrude from the bearing surface of the shaft and allow easy sliding on and off the shaft of spools with or without core, and securing the spools in place by expansion of said elements, which may operate locally or along a shaft generatrix.

The above mentioned mandrels are essentially of two types:

In the first type, the mandrel consists of a tube into which is fitted a bladder made of elastic material; when expanded, this bladder actuates lognitudinal elements or pins, causing them to protrude from the surface of the shaft. This arrangement accomplishes the purpose of locking the spool core in place; however, it has drawbacks due to the fact that since the bladder is located inside the shaft its replacement, in case of failure, requires removal of the shaft journals and disassembly of the expanding elements, an operation which is rather time-consuming.

In other types of mandrels, one or several elastic bladders are fitted into T or dovetail splines machined on the shaft surface; this makes replacement of a bladder somewhat easier than in the preceding type of shaft, but still requires disassembly of all expanding elements or pins located above the bladders. In this case, too, the operation involved is substantially time-consuming and its outcome is unpredictable, as it is performed by the user of the shaft who is less experienced than the manufacturer of the same. Moreover, the machining of T or dovetail splines on the shaft surface is a considerably difficult and time-consuming task, which contributes to the high cost of manufacturing these shafts.

The mandrels according to the present invention fall into this second category. This invention is a development of the expansible mandrel described in the Applicant's U.S. Pat. No. 3,904,144.

SUMMARY OF THE INVENTION

An object of this invention is the problem solution which makes it possible to eliminate the above said drawbacks inherent in the above outlined construction and thus reduce the cost of manufacturing the shafts, as well as to permit a much quicker replacement of defective elements.

The solution of the above said problem is accomplished, according to the invention, by a fluid pressure actuated expansion device for expansion shafts, the device including an expandable pressing shoe member having an operative body portion and a shoulder projecting from said operative body portion for delimiting the expansion stroke thereof, an inflatable tubular bladder member cooperating with said shoe member for actuating the expansion movement thereof and duct and valve means connectable with pressure fluid ducts for conducting and controlling the pressure fluid flow into and out of said bladder member, characterized in that the device further comprises a channel section shaped housing member for containing therein said shoe member and said bladder member, said housing member having an open longitudinal side thereof and a border delimiting an opening of said open side, said border having at least along a partial length thereof an inwardly projecting flange formation restricting the width of said opening, said restricted width allowing passage therethrough of said operative body portion of the shoe member and said flange formation defining together with said shoulder a stop preventing the passage of said shoulder through said restricted width opening and delimiting thereby the expansion stroke of said shoe member, said housing member having at least one additional opening for the passage therethrough of said duct means and means for removable connection thereof to the expansion shaft, the device further comprising at least one connector member opening with one end theroef into said bladder member and having an opposite end thereof extending through said additional opening of said housing member and connectable to the pressure fluid ducts and fastening and sealing means for sealingly connecting said connecting member with said bladder member and said housing, said housing with therein said bladder member and said shoe member and said connector member constituting thereby a self-contained replaceable expansion device unit.

The present invention provides essentially that both the elastic bladders and the expanding shoes located above them be fitted into a separately built channel section shaped housing member, separate from the shaft body, so as to obtain an integral or self-contained unit or component containing a bladder, expanding shoes and a connector for supplying the fluid under presure, such as compressed air. One or more of said components are subsequently fastened to the shaft surface into U-shaped, easy-to-cut slots machined in the shaft body, by means of screws and/or adhesive elements. Said components can all be simultaneously inflated and deflated through a hole with check valve drilled into the shaft body and communicating with the previously built expanding elements secured to the shaft body.

BRIEF DESCRIPTION OF THE DRAWINGS

The present invention can be better understood in the light of the following detailed description, which is provided as a mere exemplifying illustration unrestrictive of the scope of the invention, particularly with reference to the attached drawings, where.

DESCRIPTION OF THE PREFERRED EMBODIMENTS

Figures 1, 2, 3, 4, 5, 6:
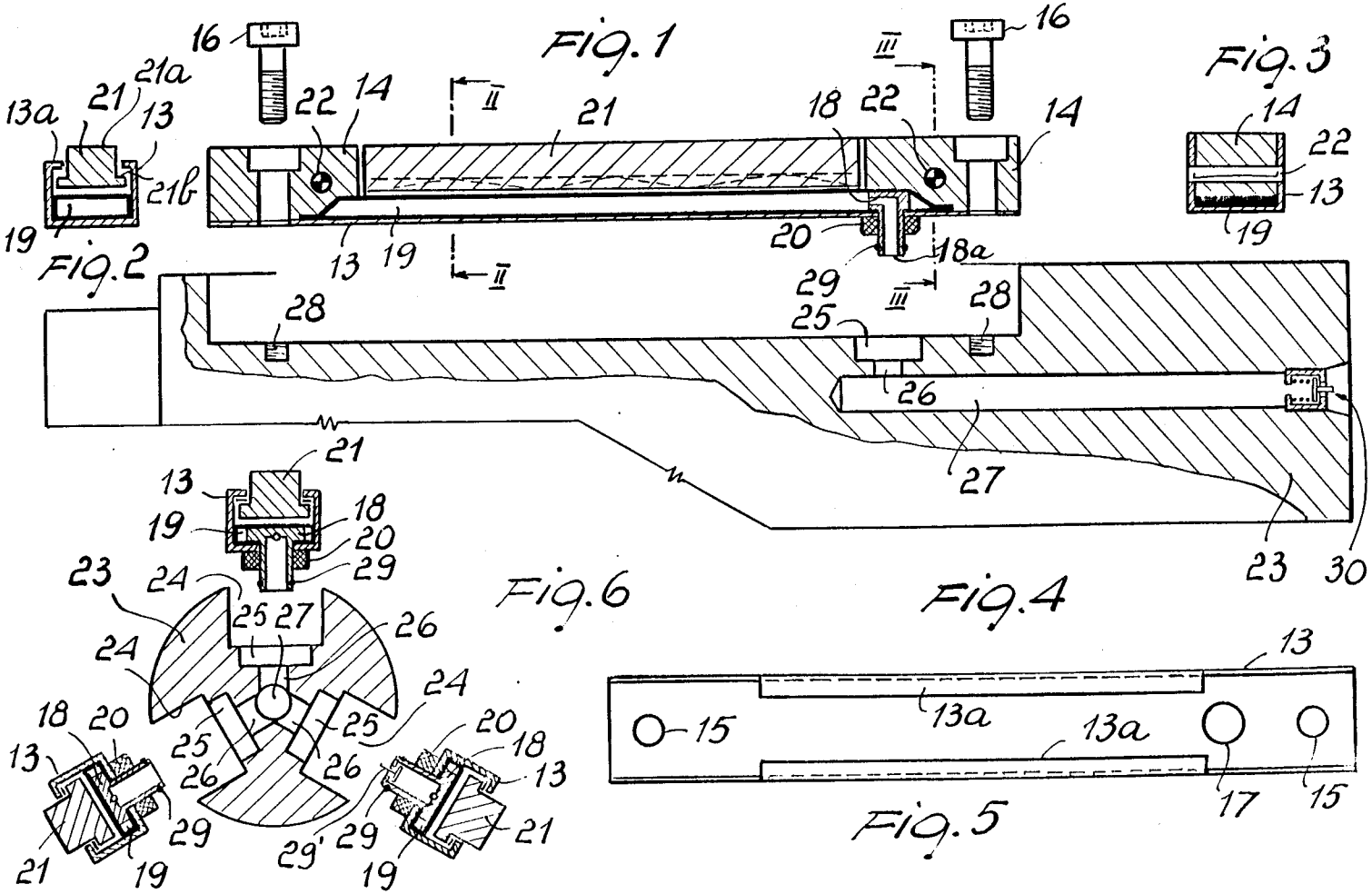
FIG. 1 shows a longitudinal section of an expanding device.
FIG. 2 shows a cross-section of said device taken along line II—II of FIG. 1.
FIG. 3 shows another cross-section of said device taken along line III—III of FIG. 1.
FIG. 4 shows a longitudinal section of the U-shaped slot machined into the shaft body and designed to receive the expanding device illustrated in the preceding FIGS.
FIG. 5 shows the channel section shaped housing member designed to receive the bladder and the expanding shoes.
FIG. 6 shows an exploded cross-section of the shaft body with three U-shaped slots machined into it and three expanding elongated devices, built and assembled prior to insertion into the shaft body.

As indicated in FIGS. 3 and 5, the flanges 13*a* at the ends of the channel section shaped housing 13 in FIG. 5 are removed in order to allow insertion of closing end blocks 14; also, holes 15 are drilled through the blocks 14 and the housing 13 at the ends thereof to permit passage of screws 16. Hole 17 provided in the housing member 13 is designed for passage of the mushroom-shaped short feed pipe connector 18. On the bottom of housing member 13 is laid a bladder 19 with the mushroom head of the connector 18 inserted into a hole made in the bladder's wall. The stem 18*a* of the connector 18 is introduced into hole 17 and secured to the housing member 13 by means of locknut 20, pressing the bladder between the head of connector 18 and the bottom of the housing member 13 and positively sealing the hole in the bladder. A pin valve 29' (FIG. 6) of the type disclosed in the above mentioned Applicant's U.S. Patent can be provided in the connector 18 in order to prevent that in case of failure of one bladder, the other bladders are deflated. Above the bladder in the housing member 13 is positioned a T-shaped expanding shoe 21, which is introduced through either end of the housing. The T-shape of the shoe provides a shoulder thereof. Closing of both ends of the bladder is obtained by means of clamping blocks 14 which press the bladder between themselves and the bottom of housing member 13 as visible in the drawing. Blocks 14 are held in this position by pins 22. At this point, the complete expanding device unit or assembly, shown in FIG. 1, and the relevant sectional views, can be inflated through the stem of the connector 18. It constitutes a complete i.e. self sustained expanding device because the fluid under pressure, introduced through the stem of connector 18, expands bladder 19 and pushes outward expanding shoe 21 until the shoulder thereof is stopped against the flange 13*a* of the housing 13. The fluid under pressure cannot escape from the bladder since the latter is closed at both ends by the blocks 14 and locknut 20, which makes a seal around connector 18. As visible in FIG. 5 the width between flanges 13*a* of the longitudinal opening of the housing 13 allows passage therethrough of the operative restricted portion 21*a* of the shoe 21 and prevents passage therethrough of the shoulder 21*b*.

Figure 7:
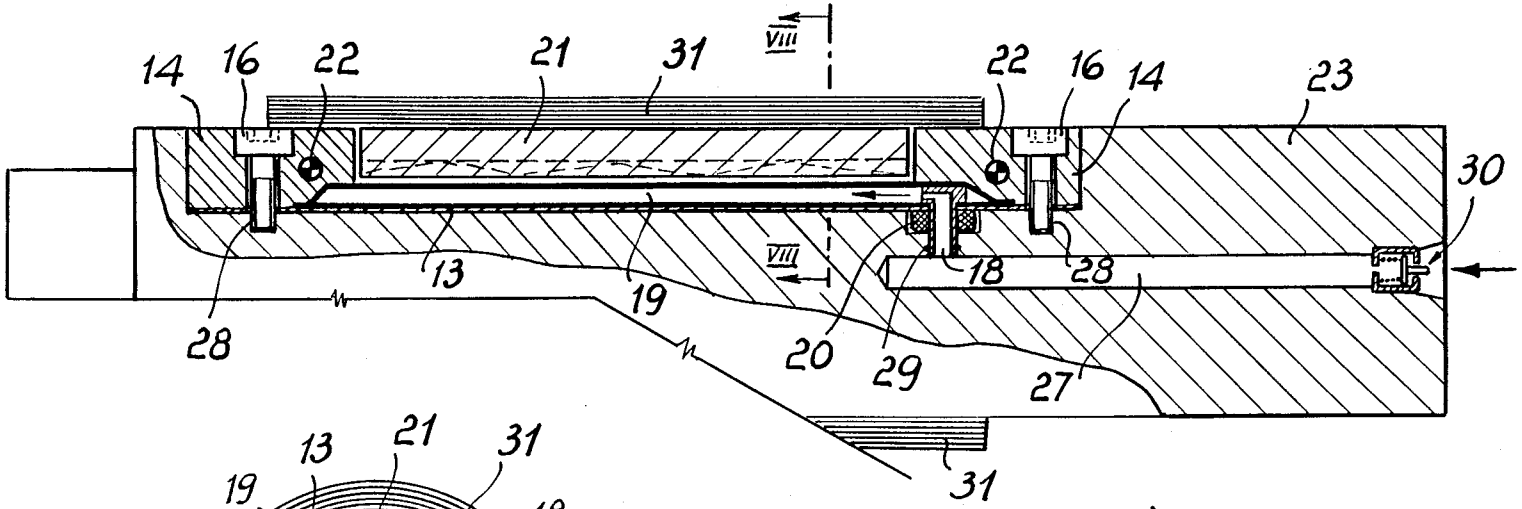
FIG. 7 shows a longitudinal section of the shaft with one expanding device mounted on it.
Figure 8:
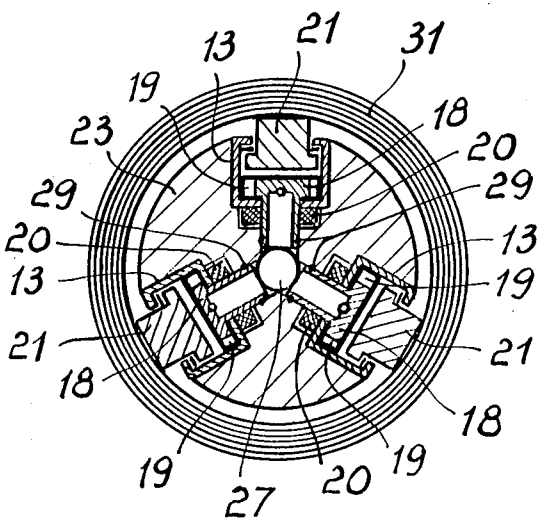
FIG. 8 shows a cross-section of the shaft with three expanding devices mounted on it, the section being taken along line VIII—VIII of FIG. 7.

FIG. 6 shows mandrel body 23 with U-shaped slots 24 machined on its periphery. These slots have a recess 25 designed to receive locknut 20, as well as holes 26 designed to contain the stem of the connector 18. Radial holes 26 converge toward the shaft center and lead into blind hole 27 drilled axially into the shaft at one end thereof and connecting said holes to each other. At this point, as shown in FIGS. 7 and 8, the expanding devices illustrated in FIG. 1 are inserted into the U-shaped slots in mandrel 23 and secured to it by means of screws 16 which are tightened into holes 28 drilled into the bottom of the U-shaped slots. Instead of or in addition to screws 16, self-adhesive tape may be applied between the bottom of U-shaped slot and the expanding element shown in FIG. 1. The seal between the stem of connector 18 and holes 26 is obtained by means of a sealing element, such as an O-ring 29, previously inserted in the appropriate groove on the stem of connector 18. At the end of axial hole 27 there is mounted a check valve 30, so that when a fluid under pressure, such as compressed air, is introduced into axial hole 27 through check valve 30, such fluid penetrates inside bladder 19 through the hole in the connector 18, causing bladder 19 to inflate and shoes 21 to project outward. Replacing a complete expanding assembly in case of failure becomes then a very simple task, as a new pre-assembled expanding device can be installed simply by loosening two screws.

FIGS. 6 and 8 show shafts equipped with three expanding devices, which obviously can be used in a larger or smaller number. The shaft is shown locked inside a tubular core 31.

I claim:

1. An expansible mandrel with a plurality of longitudinal slots on the periphery thereof and in each of said slots one fluid pressure actuated expansion device for expansion shafts, the device including an expandable pressing shoe member having an operative body portion and a shoulder projecting from said operative body portion for delimiting the expansion stroke thereof, an inflatable tubular bladder member cooperating with said shoe member for actuating the expansion movement thereof and duct and valve means connectable with pressure fluid ducts for conducting and controlling the pressure fluid flow into and out of said bladder member, characterized in that the device further comprises a channel section shaped housing member for containing therein said shoe member and said bladder member, said housing member having an open longitudinal side thereof and a border delimiting an opening of said open side, said border having at least along a partial length thereof an inwardly projecting flange formation restricting the width of said opening, said restricted width allowing passage therethrough of said operative body portion of the shoe member and said flange formation defining together with said shoulder a stop preventing the passage of said shoulder through said restricted width opening and delimiting thereby the expansion stroke of said shoe member, said housing member having at least one additional opening for the passage therethrough of said duct means and means for removable connection thereof to the expansion shaft, the device further comprising at least one connector member opening with one end thereof into said bladder member and having an opposite end thereof extending through said additional opening of said housing member and connectable to the pressure fluid ducts said opposite end having a check valve thereon and fastening and sealing means for sealingly connecting said connector member with said bladder member and said housing, said sealing means comprising two clamping blocks at both ends of said housing member sealingly pressing both open ends of said bladder between them and the bottom of said housing member and securing means for securing said blocks in place, said means for removable connection of said housing member onto the expansion shaft comprising for each housing independent fastener devices engaging said clamping blocks and removably secured on said expansion shaft, said housing with therein said bladder member and said shoe member and said connector member constituting thereby a self-contained replaceable expansion device unit.

2. A device according to claim 1, characterized in that said connector member has the shape of a mushroom with a mushroom head and a stem portion departing therefrom, said fastening means being a locknut screwed on said stem portion of said connector facing the mushroom shaped head thereof to clamp a wall portion of the bladder between said mushroom shaped head, the wall of the housing member and said locknut in the zone of the additional opening for the connector member.

* * * * *